US005538166A

United States Patent [19]

Ogawa et al.

[11] Patent Number: 5,538,166

[45] Date of Patent: Jul. 23, 1996

[54] COMBINATION PLUSH DOLL AND HANGER ASSEMBLY

[75] Inventors: Iwakichi Ogawa, Kashiwa, Japan; Shunnosuke Terui, Hartsdale, N.Y.

[73] Assignee: Matsuri Corporation, New York, N.Y.

[21] Appl. No.: 355,633

[22] Filed: Dec. 14, 1994

[51] Int. Cl.[6] ..... A47G 25/14; A47G 25/40; A63H 3/00

[52] U.S. Cl. ..... 223/85; 223/89; 223/94; 446/73; 446/330

[58] Field of Search ..... 223/85, 89, 90, 223/92, 94, 95, 98, DIG. 1; 403/79, 53, 54, 62, 63; 446/73, 330; D6/315

[56] References Cited

U.S. PATENT DOCUMENTS

| | | | |
|---|---|---|---|
| 1,882,228 | 11/1932 | Hunt | 223/89 |
| 2,355,705 | 8/1944 | Cohn | 223/DIG. 4 |
| 2,979,241 | 4/1961 | Malek | 223/94 |
| 3,205,614 | 9/1965 | Brosk | 446/73 |
| 3,430,827 | 3/1969 | Nelson | 223/89 |
| 3,475,852 | 11/1969 | Brosk | 443/73 |
| 3,623,756 | 11/1971 | Fischer | 403/62 |
| 4,300,688 | 11/1981 | London et al. | 223/94 |
| 4,997,115 | 3/1991 | Jolley | 223/89 |
| 5,201,443 | 4/1993 | Oswald | 223/94 |
| 5,257,873 | 11/1993 | Abbat | 403/53 |

*Primary Examiner*—John J. Calvert
*Assistant Examiner*—Bibhu Mohanty
*Attorney, Agent, or Firm*—Price, Gess & Ubell

[57] ABSTRACT

A combination doll and clothes hanger assembly includes an elongated frame member of a dimension to hang clothing. The frame member can have articulated joints to permit movement so that in one mode, it can act as a toy object, while in the other mode, it can be positioned to support the hanging of clothing. A doll member is integrally connected to the frame member and is configured to provide a plush toy for the enjoyment of the child.

6 Claims, 2 Drawing Sheets

COMBINATION PLUSH DOLL AND HANGER ASSEMBLY

BACKGROUND OF THE INVENTION

1. Field of the Invention

The present invention relates to a combination product of a hanger and a novelty item, such as a doll, that can provide the dual function of not only hanging or suspending clothing items, but it also can provide the novelty aspects of a doll figure.

2. Description of Related Art

The prior art is aware of various devices for suspending or supporting clothing, such as metal and wood hangers. The hangers can be suspended from horizontal rails or clothes poles that are frequently found in closets. The hangers sometimes are padded or particularly configured for connection to various forms of clothing.

Generally, these products have only utilitarian functions and are designed for a mass production to ensure a relatively cost-efficient product.

OBJECTS AND SUMMARY OF THE INVENTION

The present invention provides a combination novelty doll figure with a utilitarian hanger function for supporting clothes. A particular application of the present invention is in the field of children's clothing wherein a frame member having articulated appendages is combined with a plush doll with the arms of the doll extending over the articulated appendages to permit the arms to be moved from a stationary arcuate position for suspending clothes to subjective play action positions for the child. A hook member of a configuration that is safe for use with children can be suspended from one of the articulated frame and plush doll.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

DETAILED DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide a combination plush doll and hanger assembly.

Figure 1:
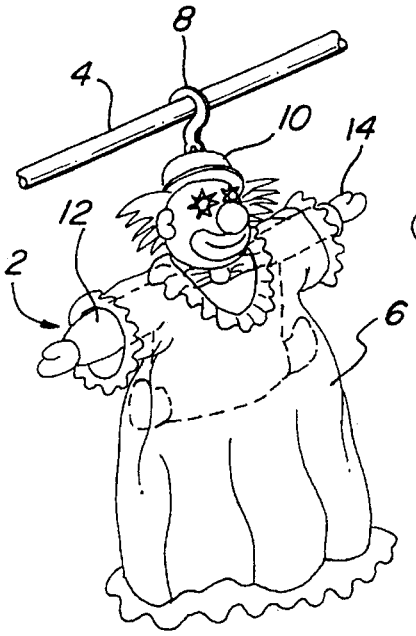
FIG. 1 is a perspective view disclosing the combination doll and clothes hanger supporting a child's dress.

Referring to FIG. 1, a plush hanger assembly 2 is disclosed supporting a child's dress 6 from a closet clothing pole 4. A molded plastic hanger hook 8 is of a sufficiently large size with rounded edges to be safe for children. The hook 8 is flexibly connected to the head 10 of a doll member. The respective arms 12 and 14 extend laterally outward from a body member 16 and in a fixed position can support or hang the clothing, such as the dress 6.

Figure 2:
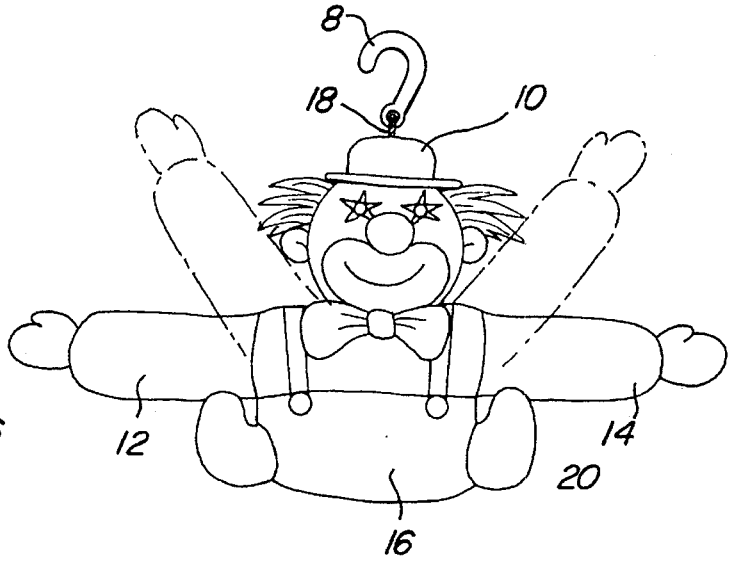
FIG. 2 is a plan view of the combination doll and clothes hanger.
Figure 3:
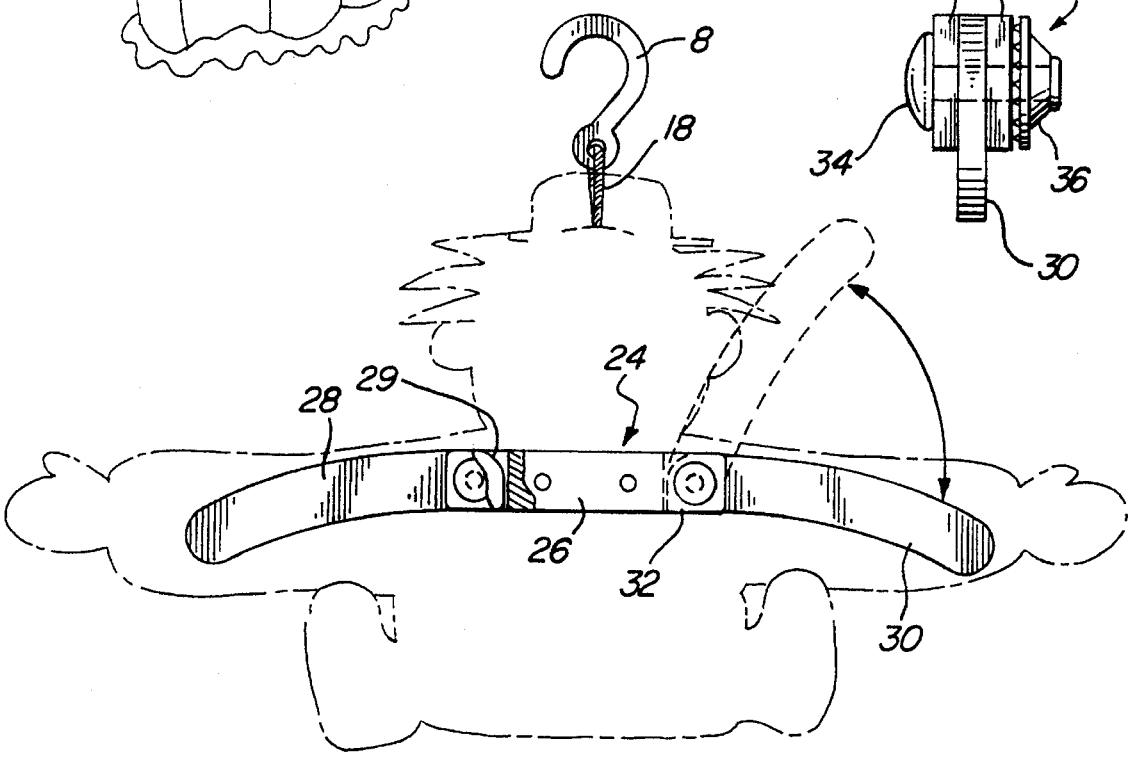
FIG. 3 is a partial cross-sectional view disclosing one form of a frame member and hook assembly relative to the doll.

The hook 8, as seen in FIGS. 2 and 3, can be connected by a flexible loop 18 that can be securely sewn to the rear portion of the head 10. The length of the loop 18 permits the hook 8 to hang adjacent and behind the doll head 10 during a play mode of use.

As can be readily determined, the plush doll can have an outer cover member 20 that can be subjectively configured over appropriate, resilient stuffing material 16 to form a particularly pleasing plush figure for the enjoyment of the child. The outer cover member 20 can be formed from one or more sections of cloth and/or plastic fabric as known in the field of plush dolls. As seen in FIGS. 1 and 2, a clown is disclosed in a first preferred embodiment. As can be readily appreciated, other configurations, such as teddy bears, cartoon characters, and other forms of plush figures, can be utilized and the present invention is not limited to a specific configuration.

The advantage of the present invention is to provide a dual function assembly wherein the utilitarian function of supporting the child's clothes, much in a manner of an ordinary hanger, is accomplished, while also providing a play object in the form of a doll that can be safely used by the child. Because the hook member 8 is flexibly attached to the plush doll, it will generally lie across the back of the doll and will not detract from the play-like qualities of the doll. Since the hook member 8 is sufficiently large without any sharp edges, the product can therefore be safely given to young children. Accompanying literature can create a story of having the doll "wear" the child's clothes and can be used to serve as an aid in instructing the child to take care of his or her clothing.

Figure 4:
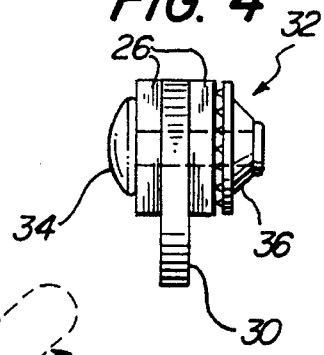
FIG. 4 is a side view of a frame member.

As shown in FIG. 3, a frame member 24 has a central body portion 26 and a pair of articulated appendages or extensions 28 and 30. The interface of the articulated appendages and the central body portion provide a pivotal joint 32 that can enable each of the respective articulated extensions to rotate in the vertical plane from a fixed lower position, shown in FIG. 3, to the upper position, shown in a phantom line. Flat surfaces at the end of the articulated extension within the joint 32 can interface with flat surfaces on the central body portion to provide a stop position to form roughly an arcuate horizontal hanger configuration, as shown in FIG. 3. An upper rounded surface 29 on the articulated extension permits the upper vertical movement. As shown in FIG. 4, a plastic bolt 34 and fastener 36 can secure the articulated extension 30 to the central body portion 26.

As further seen in FIG. 3, the plush doll portion can be appropriately dimensioned so that its arms 12 and 14 form the support surface of a hanger assembly for suspending clothes in a desired manner so that they do not become wrinkled. Since the arms can be moved, this increases the play options for the child in a toy mode of operation and further eliminates the static requirements of the conventional hanger assembly. Thus, the arms 12 and 14 can be independently moved to give a more life-like appearance to playing with the doll and then can be returned to their stationary support position for use as a hanger.

Figure 5:
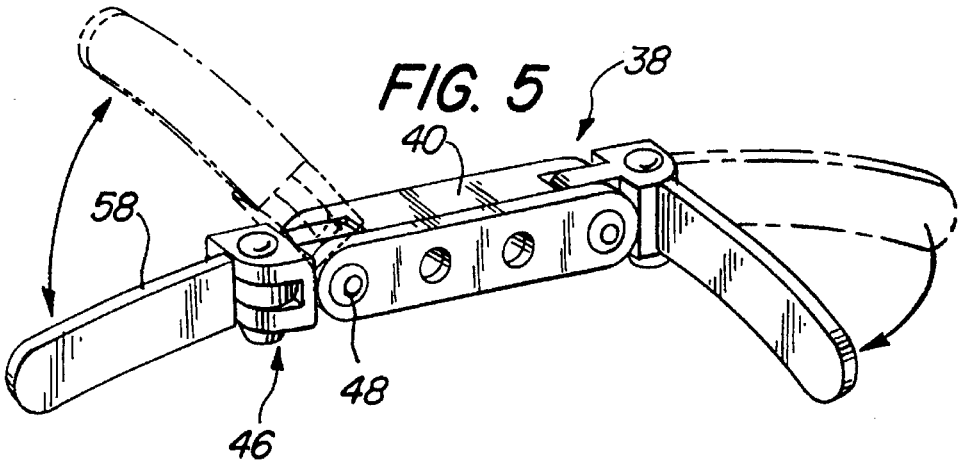
FIG. 5 is a perspective view of a second embodiment of a frame member.
Figure 6:
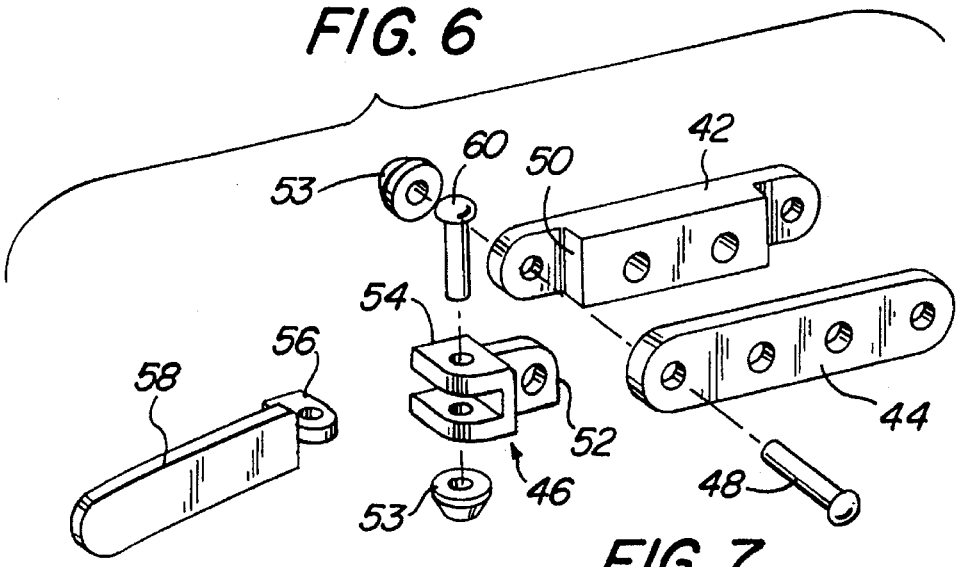
FIG. 6 is an exploded view of the embodiment of FIG. 5.

An alternative embodiment of the frame member can be seen in FIGS. 5 and 6 having a pair of dual hinges. The frame member 38 has a two-part central body member 40 including a base member 42, with a raised intermediate section and a cover plate 44. The opening that is formed at each end of the central body 40 along an axis between the base member 42 and the extensions of the cover plate 44 can receive a bi-directional joint member 46. A fastener 48 can secure a joint member 46 to the central body 40. A vertical flat surface 50 on the central body 40 can act as a stop member to a complementary end of the bi-directional joint member 46. The upper surface of that end 52 can be curved to thereby permit an upper vertical movement, while the stop member will prohibit any downward movement. This will establish a fixed stationary position for supporting clothes. The other end 54 of the joint member 46 is bifurcated and is dimensioned to capture a tab 56 on an articulated appendage 58. An appropriate plastic bolt 60 and fastener 53 can secure this connection. The tab 56 also has one surface curved to permit a horizontal rotation, as indicated by the arrows in FIG. 5. The flat surface at the base of end 54 complementary to the flat surface on the tab 56 adjacent the curve end provides an appropriate stop. As can be readily appreciated, the frame member 38, when mounted in the interior of a plush doll, will now permit appendages to not only be raised upward, as shown, for example, in FIG. 2, but also to be moved forward to thereby increase the doll-like play action of the plush hanger assembly. Because of the design of the bi-directional joint member, the frame member can be returned to a stable, horizontal position to serve the function of a hanger.

As can be appreciated, other forms of frame members can be utilized, for example, wherein the appendage members can be molded with a ball joint and appropriate stops and the central body member can also be molded with an appropriate cavity and stops to permit an assembly of the appendages to save labor cost. Alternatively, the frame member can be constructed to form directly the arms of a doll member and thereby eliminate the outer cover member and resilient stuffing material.

Figure 7:
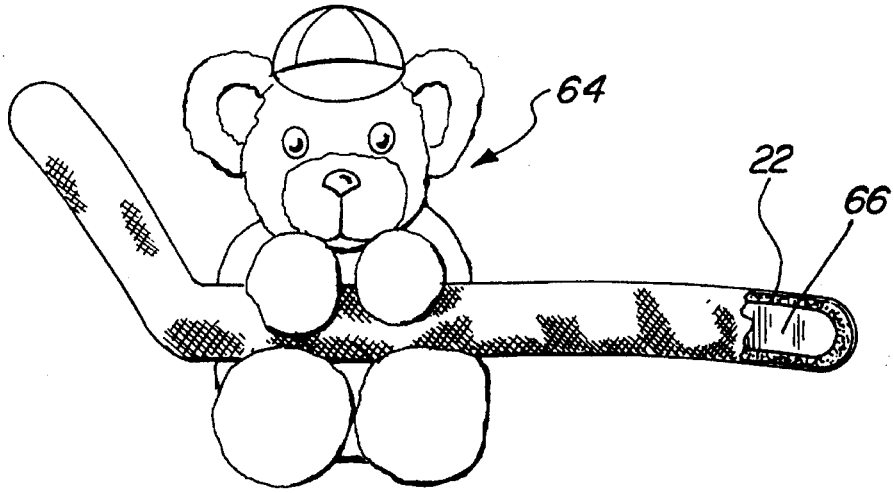
FIG. 7 is a partial plan view of another combination doll and clothes hanger.

The combination of the doll and clothes hanger can also be accomplished with the doll being appended from the frame member, as can be seen in FIG. 7. In this alternative embodiment, a teddy bear 64 is centrally positioned on a padded frame member 66 which is independently articulated from the plush doll teddy bear 64. Thus, the particular configuration of a plush doll permanently attached to a hanger can take many different configurations for the play enjoyment of a child.

While the present invention is disclosed with plush dolls for use with children, it is also possible to have plush figures of an adult novelty theme, such as a heart-shaped plush member with an arrow apparently extending through or simulating a piercing of the heart. The head and tail portions of the arrow can be moved, since it is formed by the articulated portions of the frame member. Alternatively, a human face or other portion of the body can be depicted in a plush form and the articulated appendages can comprise arms and hands that can rotate to expose or cover the face or body as a novelty item hanger.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A plush hanger assembly and doll combination comprising:

a frame member having a central body including a base member having a raised intermediate section and respective extensions at each end of the intermediate section, and a cover plate that overlaps the base member, the base member further including a stop member at each end positioned between a base member extension and an end of the overlapping cover plate, and a pair of articulated appendages movably connected to the central body at respective ends of the intermediate section between the extensions of the intermediate section and the cover plate to operatively pivot from a position in alignment with an axis of the central body to a position rotated above the central body as limited by the respective stop members, the articulated appendages being of a dimension to hang clothing;

resilient material extending over at least a portion of the frame member;

an outer cover member configured to form a simulated head with eyes, nose, and mouth and to resemble a novelty figure separate from a hanger configuration and extending over the resilient material; and means for suspending the frame member from a support structure whereby the articulated appendages can support a clothing article including a relatively rigid hook member with large radial corners to prevent injury to the user and a flexible connector member for interconnecting the hook member with the outer cover member so that the hook member can be suspended by the flexible connector member against the cover member when the plush hanger assembly is used as a toy.

2. The hanger assembly of claim 1 further including a bi-directional joint member connecting each appendage to the frame member whereby each appendage can move in a vertical and a horizontal direction.

3. The hanger assembly of claim 1 wherein the outer cover member is further configured to simulate a body and arms connected to the head, the arms extend over the articulated appendages and are movable with them.

4. A combination doll and clothes hanger as in claim 3, wherein the central body includes a pair of stop members to respectively position the appendages with the central body in an arcuate shape for supporting clothing articles.

5. A combination doll and clothes hanger assembly comprising:

a frame member having a central body and a pair of articulated appendages movably connected to the central body, and of a dimension to hang clothing;

resilient material extending over the frame member;

a doll member operatively connected to the frame member and configured to provide at least a head and arms of a simulated toy figure, the frame member having one of the articulated appendages extending respectively in each arm;

a pair of joint members, each joint member respectively interconnecting the appendage with the central body whereby the joint members permit vertical movement of the arms from a lower fixed arcuate shape to a configuration to support clothes, a portion of each joint member being formed with a single cover plate that overlaps the frame member; and hook means flexibly connected to the doll member for supporting the assembly to support clothes in one position and for lying adjacent the doll member in a play mode of operation including a plastic hook member with large radial corners to prevent injury to the user and a flexible connector member for interconnecting the hook member with the outer cover member so that the hook member can be suspended by the flexible connector member against the cover member when the plush hanger assembly is used as a toy.

6. A plush hanger assembly and doll combination comprising:

a frame member having a central body including a base member having a raised intermediate section and respective extensions at each end of the intermediate section, and a cover plate that overlaps the base member, the base member further including a stop member at each end positioned between a base member extension and an end of the overlapping cover plate, and a pair of articulated appendages movably connected to the central body by a first joint member at respective ends of the intermediate section between the extensions of the intermediate section and the cover plate to operatively pivot from a position in alignment with an axis of the central body to a position rotated above the central body as limited by the respective stop members, the articulated appendages being of a dimension to hang clothing, and further having a second joint member adjacent each respective end of the intermediate section to provide movement so that each appendage can move in a vertical and a horizontal direction;

resilient material extending over the frame member;

an outer cover member configured to simulate a head, a body, and arms, the head connected to the body and the arms movably connected to the body, with the arms extending over the articulated appendages to resemble a novelty figure separate from a hanger configuration and extending over the resilient material; and means for suspending the frame member from a support structure whereby the articulated appendages can support a clothing article including a plastic hook member with large radial corners to prevent injury to the user and a flexible connector member for interconnecting the hook member with the outer cover member so that the hook member can be suspended by the flexible connector member against the cover member when the plush hanger assembly is used as a toy.

* * * * *